US006150950A

United States Patent [19]

Shen Liu

[11] Patent Number: 6,150,950

[45] Date of Patent: Nov. 21, 2000

[54] BAND-TYPE WARNING DEVICE

[76] Inventor: Chin-Lien Shen Liu, No.106, Nan-Tzu Rd., Nan-Tzu Dist., Kaohsiung City, Taiwan

[21] Appl. No.: 09/330,340

[22] Filed: Jun. 11, 1999

[51] Int. Cl.[7] ..... G08B 5/00; F21L 15/14

[52] U.S. Cl. ..... 340/815.42; 340/321; 340/555; 362/32; 362/103; 362/108

[58] Field of Search ..... 340/815–42, 321, 340/555; 362/31, 32, 103, 108, 104, 806, 511; 2/1, 311

[56] References Cited

U.S. PATENT DOCUMENTS

| | | | |
|---|---|---|---|
| 4,365,285 | 12/1982 | Brundidge | 362/32 |
| 5,151,678 | 9/1992 | Veltri et al. | 340/321 |
| 5,176,439 | 1/1993 | Kawamura | 362/108 |
| 5,245,516 | 9/1993 | De Haas et al. | 362/108 |
| 5,515,247 | 5/1996 | Cheung et al. | 362/84 |
| 5,632,549 | 5/1997 | Fang | 362/108 |

*Primary Examiner*—Donnie L. Crosland
*Attorney, Agent, or Firm*—Limbach & Limbach L.L.P.

[57] ABSTRACT

A band-type warning device includes a buckle body, and a light-transmissive strap member with a connecting end connected to one lateral wall of the buckle body. A detachable engaging member includes jaws disposed on the other lateral wall of the buckle body, and an enlarged head portion formed on a detachable end of the strap member. A guiding cleft and a retaining groove are defined by the jaws and the lateral wall such that the head portion can be forced and retained into the retaining groove from the guiding cleft, thereby engaging the detachable end and the buckle body. A lighting element is disposed on at least one of the lateral walls to illuminate the strap member.

6 Claims, 4 Drawing Sheets

BAND-TYPE WARNING DEVICE

BACKGROUND OF THE INVENTION

1. Field of the Invention

This invention relates to a band-type warning device, more particularly to a band-type warning device adapted to be strapped around a body part for ease of recognition in a dim environment.

2. Description of the Related Art

A conventional method for recognition in a dim environment is to wear a warning garment having reflective strips disposed thereon. However, it is inconvenient for the user to wear and carry the warning garment.

SUMMARY OF THE INVENTION

The object of the present invention is to provide a band-type warning device which can be conveniently strapped around a body part.

According to this invention, the band-type warning device includes a buckle body which has right and left lateral walls opposite to each other in a longitudinal direction, and front and rear walls opposite to each other in a first transverse direction, and interposed between the right and left lateral walls. A light-transmissive strap member has front and rear major surfaces, and a connecting end connected to the right lateral wall such that the front and rear major surfaces are proximate to the front and rear walls respectively in the first transverse direction. A detachable engaging member is disposed to bring a detachable end of the strap member into engagement or disengagement with the left lateral wall. Upon engagement, the front and rear major surfaces cooperate with the front and rear walls to form outwardly and inwardly oriented circumferences, respectively. A lighting element is disposed on at least one of the right and left lateral walls to emit luminous light in the longitudinal direction, and inwardly of the outwardly oriented circumference so as to illuminate the strap member.

Preferably, the engaging member includes a pair of jaws which are disposed on the left lateral wall and which are spaced apart from each other in the first transverse direction. Each jaw extends from the left lateral wall longitudinally and transversely so as to define with the other jaw a guiding cleft which extends in a second transverse direction transverse to the first transverse direction and the longitudinal direction. Thus, the detachable end of the strap member can be inserted therein in the second transverse direction. In addition, a retaining groove is defined by the jaws and the left lateral wall, and extends in the second transverse direction to communicate with the guiding cleft. The engaging member further includes an enlarged head portion which is integrally formed with the detachable end. When the detachable end is inserted into the guiding cleft, the enlarged head portion will be forced into the retaining groove and will be retained therein as the detachable end is pulled in the longitudinal direction.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
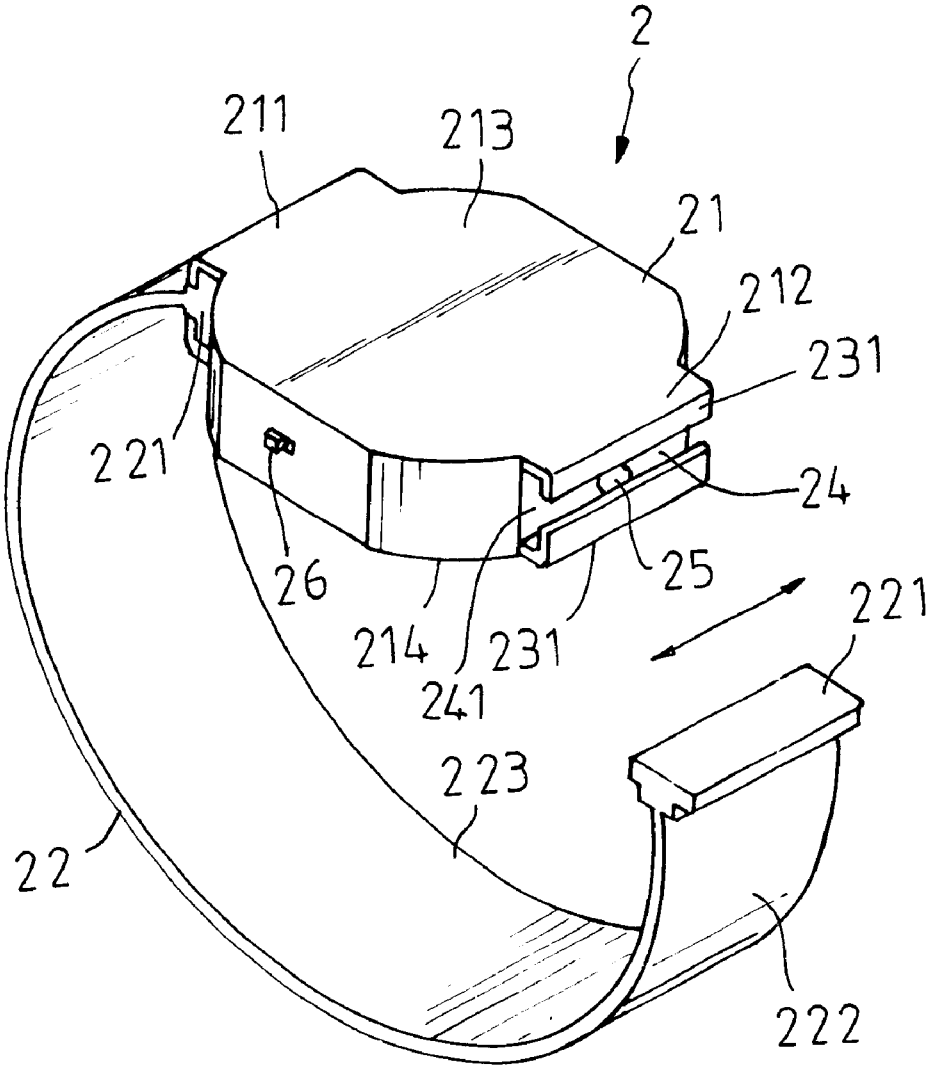
FIG. 1 is a perspective view of a first preferred embodiment of a band-type warning device according to this invention.

Referring to FIG. 1, the first preferred embodiment of the band-type warning device 2 according to the present invention is shown to comprise a buckle body 21 and a strap member 22.

The buckle body 21 includes right and left walls 212, 211 opposite to each other in a longitudinal direction, and front and rear walls 213, 214 opposite to each other in a first transverse direction and interposed between the right and left walls 212, 211. A pair of L-shaped jaws 231 are disposed on each of the right and left lateral walls 212, 211, and are spaced apart from each other in the first transverse direction. Each jaw 231 extends from the left lateral wall 211 (or the right lateral wall 212) longitudinally and transversely so as to define with the other jaw 231 a guiding cleft 24 which extends in a second transverse direction transverse to both of the first transverse direction and the longitudinal direction. In addition, a retaining groove 241 is defined by the pair of jaws 231 and the left lateral wall 211 (or the right lateral wall 212), and extends in the second transverse direction to communicate with the guiding cleft 24.

The strap member 22 is made of a light-transmissive elastomeric material, and is provided with front and rear major surfaces 222, 223. The strap member 22 has two connecting ends, each of which is formed integrally with an enlarged head portion 221.

Two lighting elements 25 are disposed on the right and left lateral walls 212, 211 respectively to emit luminous light in the longitudinal direction. A switch member 26 is connected to the lighting elements 25 to control activation of the latter.

Figure 2:
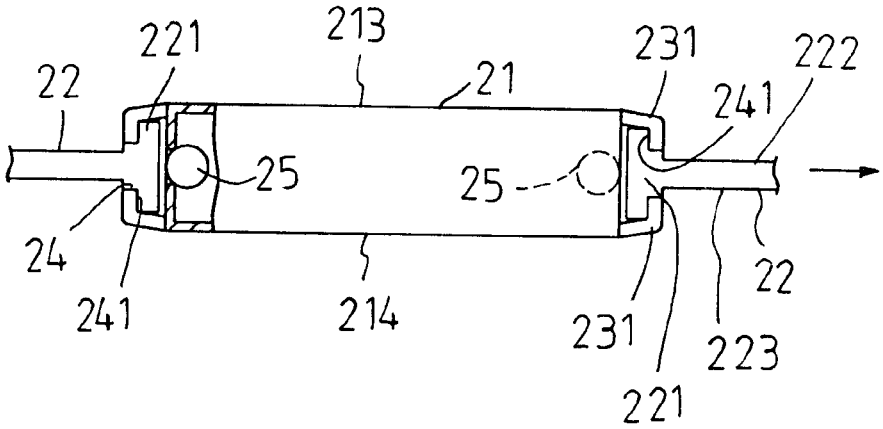
FIG. 2 is a fragmentary schematic sectional view of the first preferred embodiment.

In assembly, with reference to FIG. 2, the enlarged head portion 221 of each connecting end of the strap member 22 is inserted into the guiding cleft 24 in the second transverse direction, and is forced into the retaining groove 241 so as to be retained therein as the strap member 22 is pulled in the longitudinal direction. In this state, the front and rear major surfaces 222, 223 of the strap member 22 cooperate with the front and rear walls 213, 214 of the buckle body 21 to form outwardly and inwardly oriented circumferences, respectively. In use, the strap member 22 is strapped around a user's wrist. The lighting elements 25 can be activated to permit the luminous light to beam through the guiding clefts 24 in the longitudinal direction, and inwardly of the outwardly oriented circumference so as to illuminate the strap member 22. As such, it is convenient to engage the enlarged head portions 221 with the jaws 231, thereby facilitating wearing of the band-type warning device. In addition, recognition in a dim environment is made easier due to the luminous light.

Figure 3:
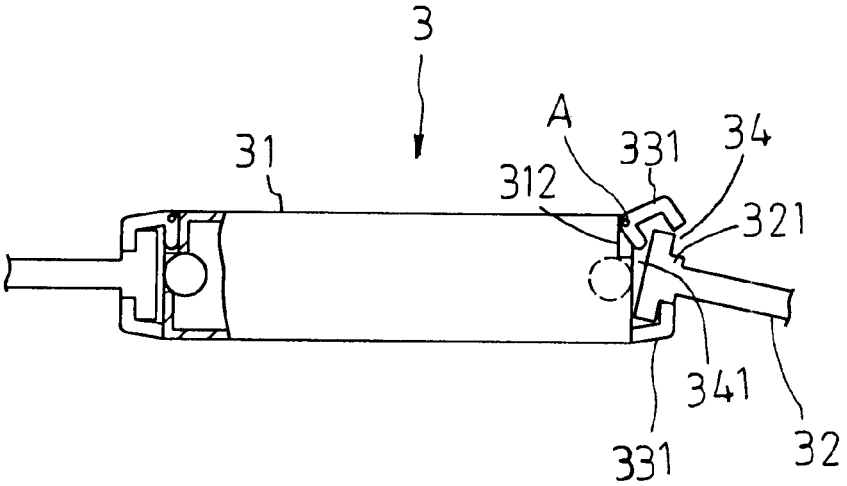
FIG. 3 is a fragmentary schematic sectional view of a second preferred embodiment of the band-type warning device according to the present invention.

Referring to FIG. 3, the second preferred embodiment of the band-type warning device 3 according to this invention is shown to be similar to the first preferred embodiment in construction, except that one of the jaws 331 of the buckle body 31 is mounted pivotally on a respective site of the left lateral wall 312 about a pivot axis (A) which is parallel to the second transverse direction, thereby enabling widening the guiding cleft 34 by turning the jaw 331 about the pivot axis (A) so as to facilitate insertion of the enlarged head portion 321 of the strap member 32 into the retaining groove 341.

Figure 4:
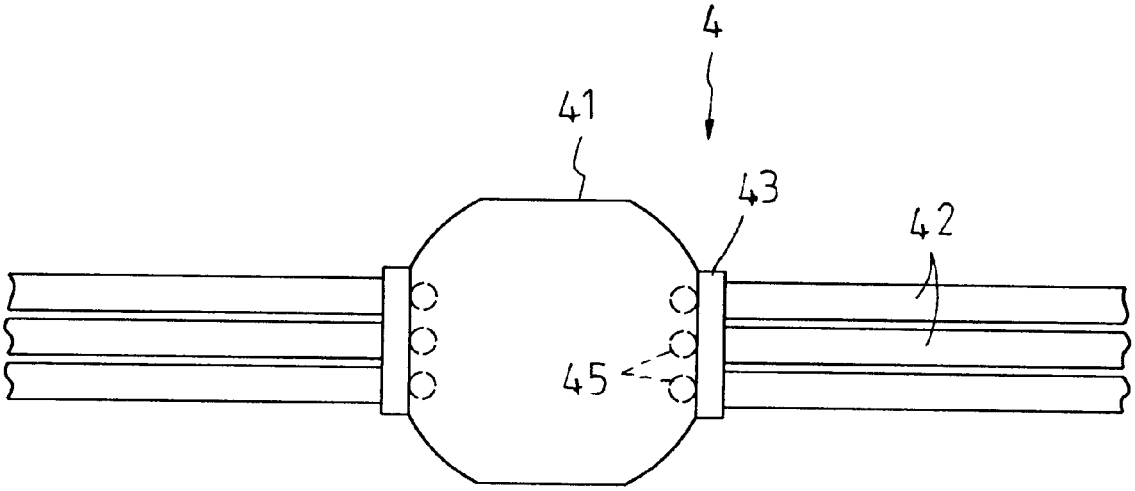
FIG. 4 is a front view of a third preferred embodiment of the band-type warning device according to the present invention.

Referring to FIG. 4, the third preferred embodiment of the band-type warning device 4 is shown to also comprise a buckle body 41 and a strap member 42. The strap member 42 includes a plurality of band portions 42. A plurality of lighting elements 45 of different colors are disposed on the buckle body 41 so as to illuminate the band portions 42, respectively.

Figure 5:
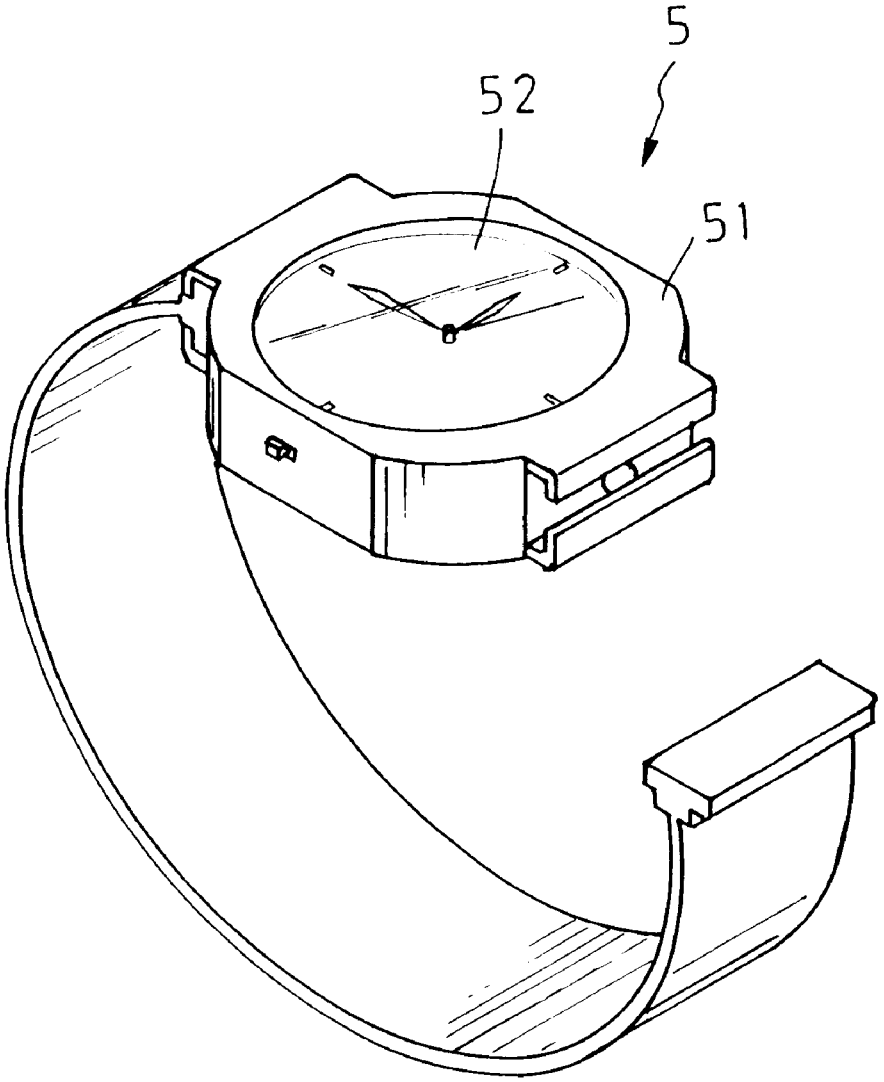
FIG. 5 is a perspective view of a fourth preferred embodiment of the band-type warning device according to the present invention.

Alternatively, referring to FIG. 5, the band-type warning device 5 may be provided with a dial 52 which is disposed on the buckle body 51 to serve as a watch.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A band-type warning device adapted to be strapped around a body part for ease of recognition in a dim environment, said warning device comprising:

a buckle body including right and left lateral walls opposite to each other in a longitudinal direction, and front and rear walls opposite to each other in a first transverse direction, and interposed between said right and left lateral walls;

a strap member made of a light-transmissive material and provided with front and rear major surfaces, said strap member including a detachable end, and a connecting end secured to said right lateral wall such that said front and rear major surfaces are proximate to said front and rear walls respectively in the first transverse direction;

a detachable engaging member disposed to bring said detachable end into engagement or disengagement with said left lateral wall such that upon engagement, said front and rear major surfaces cooperate with said front and rear walls to form outwardly and inwardly oriented circumferences, respectively; and a lighting element disposed on at least one of said right and left lateral walls to emit luminous light in the longitudinal direction, and inwardly of said outwardly oriented circumference so as to illuminate said strap member.

2. The band-type warning device according to claim 1, wherein said detachable engaging member includes:

a pair of jaws disposed on said left lateral wall and spaced apart from each other in the first transverse direction, each of said jaws extending from said left lateral wall longitudinally and transversely so as to define with the other one of said jaws a guiding cleft which extends in a second transverse direction transverse to both of the first transverse direction and the longitudinal direction, and which is of such a dimension to admit insertion of said detachable end in the second transverse direction, and so as to define with the other one of said jaws and said left lateral wall a retaining groove which extends in the second transverse direction and which is communicated with said guiding cleft; and an enlarged head portion integrally formed with said detachable end and of a dimension such that, when said detachable end is inserted into said guiding cleft, said enlarged head portion will be forced into said retaining groove and will be retained therein as said detachable end is pulled in the longitudinal direction.

3. The band-type warning device according to claim 2, wherein said lighting element is disposed to permit the luminous light to beam through said guiding cleft in the longitudinal direction.

4. The band-type warning device according to claim 3, wherein one of said jaws is disposed to be pivotally mounted on a respective site of said left lateral wall about a pivot axis which is parallel to the second transverse direction, thereby enabling widening of said guiding cleft by turning said one of said jaws about said pivot axis so as to facilitate insertion of said enlarged head portion into said retaining groove.

5. The band-type warning device according to claim 4, further comprising a switch member connected to said lighting element to control activation of said lighting element.

6. The band-type warning device according to claim 1, wherein said buckle body has a dial disposed on said front wall.

* * * * *